US005962763A

United States Patent [19]

Cossee et al.

[11] Patent Number: 5,962,763

[45] Date of Patent: Oct. 5, 1999

[54] ATMOSPHERIC DISTILLATION OF HYDROCARBONS-CONTAINING LIQUID STREAMS

[75] Inventors: Robert Paul Henri Cossee; Johan Jan Barend Pek, both of Amsterdam, Netherlands

[73] Assignee: Shell Oil Company, Houston, Tex.

[21] Appl. No.: 09/176,081

[22] Filed: Oct. 20, 1998

[30] Foreign Application Priority Data

Nov. 21, 1997 [EP] European Pat. Off. ..... 972 03 654

[51] Int. Cl.[6] ..... B01D 3/00; B01D 3/34; C07C 7/144; C07C 7/00

[52] U.S. Cl. ..... 585/818; 208/350; 208/349; 208/356; 585/802; 203/DIG. 19

[58] Field of Search ..... 208/347, 349, 208/350, 355, 356; 585/802, 818; 203/DIG. 19, 99, 98; 196/99, 100

[56] References Cited

U.S. PATENT DOCUMENTS 4,191,640 3/1980 Chess et al. ..... 208/348

4,626,321 12/1986 Grethlein et al. ..... 203/26

4,793,841 12/1988 Burr ..... 62/27

*Primary Examiner*—Walter D. Griffin

*Assistant Examiner*—Tam M. Nguyen

[57] ABSTRACT

A method of distilling a crude oil and a contaminated liquid stream in an atmospheric distillation column (2) comprising the steps of (a) heating (13, 15) the crude oil at atmospheric pressure and introducing the heated crude oil into the inlet section (10) of the column (2); (b) removing from bottom a residue (19), removing from the top an overhead (20) and removing from the rectification section (7) at least one side stream (26, 28); (c) cooling (13) one of the side streams (28) and introducing the cooled side stream (29) into the rectification section (7) and partly condensing (21) the overhead (20) and introducing the condensed fraction (24) into the upper end of the distillation column (2); (d) supplying the contaminated liquid stream (40) to a membrane unit (3) provided with a suitable membrane (33), and removing a permeate (37) and a retentate (36); and (e) introducing the permeate (37) into the rectification section (7) and adding the retentate (36) to the crude oil (11) upstream of the furnace (1).

1 Claim, 1 Drawing Sheet

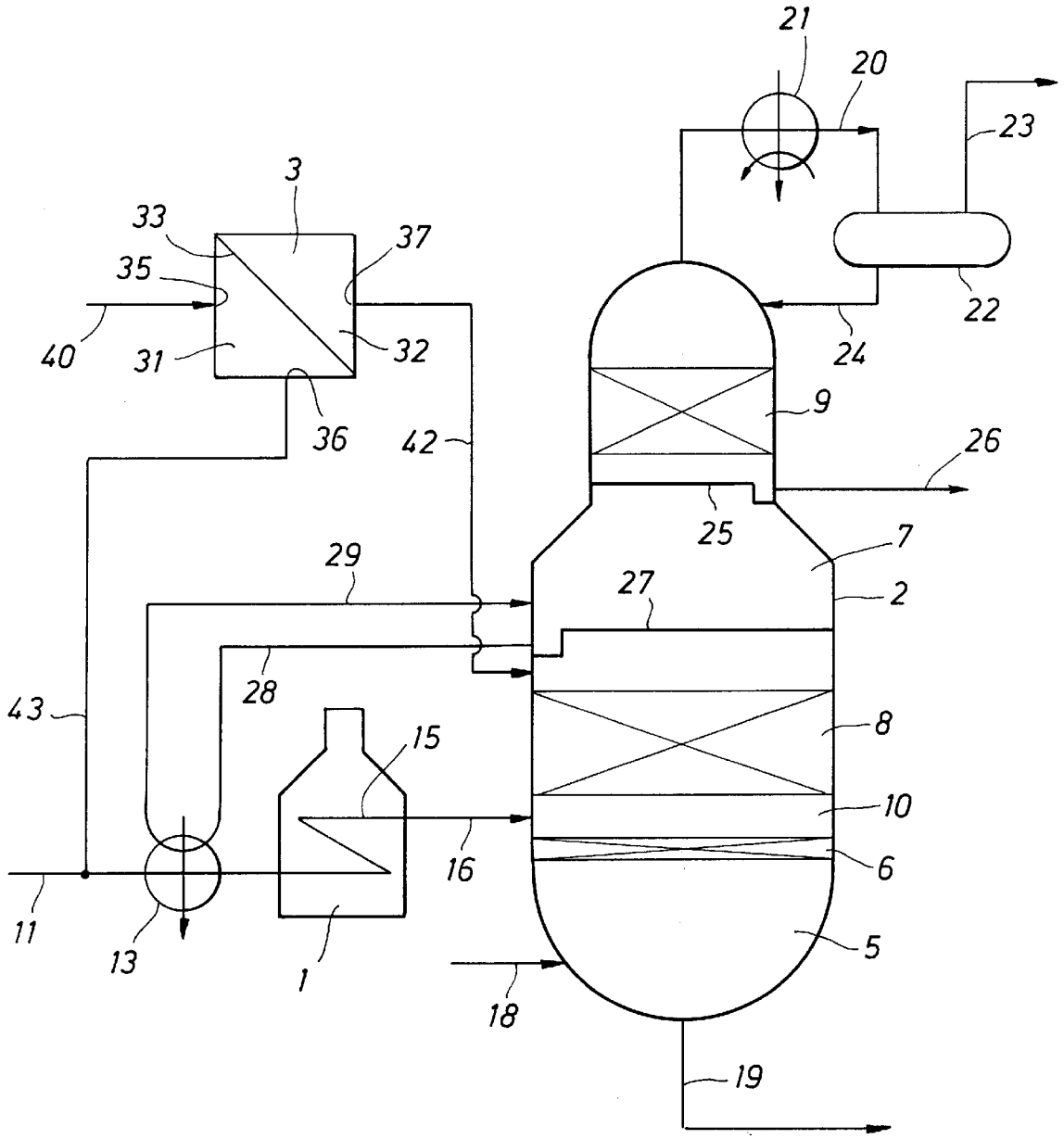
21
20
23
3
33
37
35
22
40
31
32
24
9
36
42
26
25
7
29
27
2
28
43
8
15
10
16
6
11
13
1
5
18
19

ATMOSPHERIC DISTILLATION OF HYDROCARBONS-CONTAINING LIQUID STREAMS

1. FIELD OF THE INVENTION

The present invention relates to distilling hydrocarbons-containing liquid streams in an atmospheric distillation column. More in particular the present invention relates to distilling a crude oil and a contaminated liquid stream which is a stream containing light hydrocarbons and a contaminant or contaminants, wherein the light hydrocarbons are hydrocarbons in the boiling range of naphtha and gasoil.

2. BACKGROUND OF THE INVENTION

Normally distilling a hydrocarbons-containing liquid stream in an atmospheric distillation column comprising a stripping section, a rectification section and an inlet section located between the stripping and the rectification section, comprises the steps of (a) heating the hydrocarbons-containing liquid stream at atmospheric pressure in a furnace to a predetermined temperature, and introducing the heated stream into the inlet section of the atmospheric distillation column;

(b) removing from bottom of the atmospheric distillation column a residue, removing from the top an overhead and removing from the rectification section at least one side stream; and (c) cooling at least part of at least one of the side streams and introducing the cooled side stream(s) into the rectification section at a level above the level of removal, and partly condensing the overhead and introducing the condensed fraction of the overhead into the upper end of the atmospheric distillation column.

The hydrocarbons-containing liquid stream of step (a) is normally a crude oil.

Applicant is interested in co-distilling a contaminated liquid stream containing light hydrocarbons with the crude oil.

In relation to the present invention two contaminants are of particular interest. On the one hand hydrocarbons with a high boiling point (above 480° C.) and on the other hand salts present in water droplets which are dispersed in the stream of light hydrocarbons.

Examples of hydrocarbons with a high boiling point are polynuclear aromatics, polynuclear cycloparaffins, large paraffinic hydrocarbons (waxes), and olefinic components such as polynuclear cycloolefins and large olefinic hydrocarbons specially diolefins. These high boiling point hydrocarbons are soluble in the light hydrocarbons, and the solution usually has a darker colour for example an ASTM colour of 3 or more, determined in accordance with ASTM D1500. An example of a contaminated liquid stream containing light hydrocarbons is a black condensate, which is a mixture of hydrocarbons which are sometimes produced with natural gas having an ASTM colour of 3 or more. The contaminated liquid may also include waste streams for the refinery.

The salts in the hydrocarbon streams will come from formation water or from other treatments at a refinery, examples of contaminating salts are sodium chloride, magnesium chloride, calcium chloride and iron chloride. Other salts, such as sulphates may be present as well.

In case the contaminated liquid stream would only contain contaminants in the form of high boiling hydrocarbons, the contaminated liquid stream could simply be passed directly to the furnace. And in case the contaminant is a salt, optionally in combination with high boiling hydrocarbons, the contaminated liquid stream could be indirectly passed to the furnace. Before entering into the furnace, the salt is removed in a crude oil desalter upstream of the furnace.

This is simple way of co-distilling the contaminated liquid stream. However, a disadvantage of this way of co-distilling is that the two streams have to be heated to the predetermined temperature to form a mixture of vapour and liquid that is supplied to the distillation column.

There is a further disadvantage and that is associated with obtaining the reflux in step (c). Both the light hydrocarbons of the contaminated liquid stream and the light hydrocarbons of the crude oil are vaporized and subsequently partly condensed in the rectification section. In order to condense the light hydrocarbons heat has to be removed, and that is done in step (c), and the amount of heat that has to be removed is proportional to the amount of hydrocarbons that has to be condensed. Thus the larger the amount of light hydrocarbons, the more heat has to be removed. This heat, however, has to be supplied to the hydrocarbons-containing stream before it enters into the atmospheric distillation column. Thus, if the contaminated liquid stream is mixed with the crude oil, a larger amount of heat has to be supplied. Moreover it can be the case that there is not enough heat exchange surface area available to transfer the required amount of heat.

Thus there are two drawbacks of mixing the contaminated liquid stream with the crude oil: a larger stream has to be heated, and more heat has to be removed. These larger amounts of heat that have to be transferred require larger heat exchange surface areas.

3. SUMMARY OF THE INVENTION

It is an object of the present invention to reduce the amount of heat that has to be exchanged.

To this end the method of distilling a crude oil and a contaminated liquid stream containing light hydrocarbons in an atmospheric distillation column comprising a stripping section, a rectification section and an inlet section located between the stripping and the rectification section, according to the present invention comprises the steps of (a) heating the crude oil at atmospheric pressure to a predetermined temperature in a furnace, and introducing the heated crude oil into the inlet section of the atmospheric distillation column;

(b) removing from bottom of the atmospheric distillation column a residue, removing from the top an overhead and removing from the rectification section at least one side stream;

(c) cooling at least part of at least one of the side streams and introducing the cooled side stream(s) into the rectification section at a level above the level of removal, and partly condensing the overhead and introducing the condensed fraction of the overhead into the upper end of the atmospheric distillation column;

(d) supplying the contaminated liquid stream containing light hydrocarbons to the inlet of a membrane unit provided with a membrane, and removing from the permeate side a permeate and from the retentate side a retentate; and (e) introducing the permeate into the rectification section and supplying the retentate to the furnace.

Because the retentate is a small stream, only a limited amount of extra heat has to be transferred in the furnace. Moreover, relatively cold permeate is introduced into the rectification section, and this helps to control the temperature in the atmospheric distillation column.

4. BRIEF DESCRIPTION OF THE DRAWING

FIG. 1 is a schematic showing of an atmospheric distillation column equipped with an overhead, a rectification section, a separation stage, and a stripping section.

5. DETAILED DESCRIPTION OF THE INVENTION

In case the contaminant comprises hydrocarbons with a high boiling point, the membrane is a nanofiltration membrane and the retentate is directly supplied to the furnace. In case the contaminant is a salt, the membrane is an ultrafiltration membrane and the retentate is indirectly, via a crude oil desalter, supplied to the furnace. And in case both contaminants are present, the membrane is a nanofiltration membrane and the retentate is indirectly, via a crude oil desalter, supplied to the furnace.

The invention will now be described by way of example in more detail with reference to the accompanying drawing showing schematically a plant for carrying out the present invention.

The plant comprises a furnace 1, an atmospheric distillation column 2 and a membrane unit 3. The atmospheric distillation column 2 is provided with a stripping section 5 comprising at least one theoretical separation stage 6, a rectification section 7 comprising a plurality of theoretical separation stages 8 and 9, and an inlet section 10 arranged between the stripping section 5 and the rectification section 7.

In the method according to the present invention, a crude oil is supplied at atmospheric pressure through conduit 11 after preheating in heat exchanger 13 to the furnace 1. In coil 15 the crude oil is partially vaporized. The temperature of the crude oil leaving the furnace 1 is in the range of from 300 to 380° C.

Through conduit 16 the heated crude oil into the inlet section 10 of the atmospheric distillation column 2. Through conduit 18 stripping steam is supplied to the stripping section 5 of the atmospheric distillation column.

The unvaporized liquid from the crude oil is stripped by the stripping steam and is collected in the bottom of the atmospheric distillation column 2, and the vapours pass upwards through the column 2. Heat is removed from the upwardly passing vapours so that they condense and give a downwardly flowing liquid. From the bottom of the atmospheric distillation column 2 is removed a residue through conduit 19, and from the top an overhead is removed through conduit 20.

The overhead is partly condensed by indirect heat exchange in heat exchanger 21. In separator 22, the condensed fraction and gas are separated. Gas is removed through conduit 23, and the condensed fraction is returned via conduit 24 into the atmospheric distillation column as reflux.

From the rectification section 7 are removed two side streams, a first one via draw-off tray 25 and conduit 26, and a second one via draw-off tray 27 and conduit 28. The second side stream 28 is cooled by indirect heat exchange in heat exchanger 13 to preheat the crude oil. The cooled side stream is introduced via conduit 29 into the rectification section 7 at a level above the level of removal. Suitably at least one theoretical separation stage (not shown) is present between the level of introduction and the level of removal of the side stream. The second stream is the circulating reflux. The temperature in the atmospheric distillation column 2 is controlled by varying the amounts of reflux and circulating reflux.

The introduction of part of the contaminated liquid stream in the rectification section 7 helps to control the temperature. To prevent fouling, the contaminated liquid stream is first treated in the membrane unit 3.

The membrane unit 3 has a retentate side 31 and a permeate side 32 separated therefrom by a suitable membrane 33. The retentate side has an inlet 35 and an outlet 36, and the permeate side has an outlet 37.

The contaminated liquid stream containing light hydrocarbons is supplied through conduit 40 to the inlet 35 of the retentate side 31 of the membrane unit 33. From the permeate side 32 a permeate is removed through conduit 42, and from the retentate side 31 a retentate is removed through conduit 43.

The permeate is substantially free from contaminants, and the removed contaminants are in the retentate steam.

The retentate is added to the crude oil upstream of the furnace 1, and in this case upstream of the heat exchanger 13. In this way the retentate partly vaporized and passed on to the atmospheric distillation column 2, and valuable light components are recovered.

Where the retentate contains salt it can be passed to the crude oil desalter (not shown) upstream of the heat exchanger 13.

The permeate is introduced into the rectification section 7 of the atmospheric distillation column 2 at a level where its temperature matches the temperature in the rectification section 7.

The membrane separation is carried out at a temperature in the range of from 10 to 100° C. and suitably at 40° C., and the mass ratio between permeate and retentate is between 1 and 20 and suitably between 5 and 10.

Where the contaminants comprise hydrocarbons with a high boiling point, the membrane suitably used in the membrane unit 33 is a nanofiltration membrane. A suitable material for such a nanofiltration membrane is a polysiloxane and suitably a poly(di-methyl siloxane). The nanofiltration membrane is operated with a trans-membrane pressure of between 1 and 8 MPa and a flux of between 1,000 and 4,000 kg/m$^2$ membrane area per day.

Where the contaminant is a salt an ultrafiltration membrane is used. Suitable ultrafiltration membrane materials are polytetrafluoroethylene (PTFE) and poly(vinylidene fluoride) (PVDF), in addition also ceramic membranes can be used. The ultrafiltration membrane is operated with a trans-membrane pressure of between 0.2 and 1 MPa and a flux of between 3,000 and 20,000 kg/m$^2$ membrane area per day.

The nanofiltration membrane is used as well where both contaminants are present.

The amount of contaminated liquid is suitably in the range of 0.01 to 0.25 kg per kg of crude oil.

In the method of the present invention, only the retentate and the crude oil have to be heated in the furnace, and because the retentate is a fraction of the contaminated liquid stream, it means that the method of the present invention is more heat efficient than a method wherein the whole contaminated liquid stream is mixed with the crude oil.

Moreover the relatively cold permeate which is introduced into the rectification section 7 helps in controlling the temperature in the atmospheric distillation column 2. Therefore the amount of reflux can be reduced, or alternatively for the same amount of reflux a larger amount of crude oil can be distilled.

We claim:

1. A method of distilling a crude oil and a contaminated liquid stream containing light hydrocarbons in an atmospheric distillation column comprising a stripping section, a rectification section and an inlet section located between the stripping and the rectification section, which method comprises the steps of (a) heating the crude oil at atmospheric pressure to a predetermined temperature in a furnace, and introducing the heated crude oil into the inlet section of the atmospheric distillation column;

(b) removing from the bottom of the atmospheric distillation column a residue, removing from the top of the column an overhead, and removing from the rectification section of the column at least one side stream;

(c) cooling at least part of at least one of the side streams and introducing the cooled side stream(s) into the rectification section at a level above the level of removal, and partly condensing the overhead and introducing the condensed fraction of the overhead into the upper end of the atmospheric distillation column;

(d) supplying the contaminated liquid stream containing light hydrocarbons to the inlet of a membrane unit provided with a membrane, and removing from the permeate side a permeate and from the retentate side a retentate; and (e) introducing the permeate into the rectification section and adding the retentate to the crude oil upstream of the furnace.

* * * * *